US011530093B1

(12) United States Patent
Recktenwald

(10) Patent No.: US 11,530,093 B1
(45) Date of Patent: Dec. 20, 2022

(54) REFUSE RECEPTACLE ACCESSORY

(71) Applicant: Renee Recktenwald, Sewickley, PA (US)

(72) Inventor: Renee Recktenwald, Sewickley, PA (US)

( * ) Notice: Subject to any disclaimer, the term of this patent is extended or adjusted under 35 U.S.C. 154(b) by 0 days.

(21) Appl. No.: 17/083,553

(22) Filed: Oct. 29, 2020

(51) Int. Cl.
*B65F 1/14* (2006.01)
*B65F 1/06* (2006.01)

(52) U.S. Cl.
CPC ..... *B65F 1/1415* (2013.01); *B65F 1/068* (2013.01); *B65F 2210/1023* (2013.01); *B65F 2210/1815* (2013.01)

(58) Field of Classification Search
CPC ..... B65F 1/1415; B65F 1/141; B65F 1/1429; B65F 1/14; B65F 1/09; B65F 1/06; B65F 1/067; B65F 1/068; B65F 2210/1023; B65F 2210/1815
USPC ..... 248/95, 97, 98
See application file for complete search history.

(56) References Cited

U.S. PATENT DOCUMENTS 1,213,194 A * 1/1917 Hill ..... A47G 7/07 47/41.11
1,341,507 A * 5/1920 Jacobsson ..... B65F 1/04 220/495.01
1,947,835 A * 2/1934 Dubbs ..... B65F 1/06 220/495.07
2,104,686 A * 1/1938 Wood ..... B65F 1/06 220/495.11
2,433,945 A * 1/1948 Foreman ..... B65F 1/08 383/10
3,757,990 A * 9/1973 Buth ..... B44D 3/126 220/570
3,782,773 A * 1/1974 Mason ..... B60P 3/41 296/3
4,140,257 A * 2/1979 Peterson ..... B65D 63/18 294/151
4,570,423 A * 2/1986 DeLong ..... B65B 25/02 248/97
4,628,007 A * 12/1986 Ledsham ..... B65D 33/02 141/390
4,869,391 A * 9/1989 Farrington ..... B65F 1/062 220/495.07
4,890,760 A * 1/1990 Nicoll, Sr. ..... B65F 1/06 220/495.04
4,951,831 A * 8/1990 Roesch ..... B65F 1/06 141/316
5,028,022 A * 7/1991 Metcalf ..... B65F 1/06 248/95

(Continued)

*Primary Examiner* — Nkeisha Smith
(74) *Attorney, Agent, or Firm* — Sanchelima & Associates, P.A.; Christian Sanchelima; Jesus Sanchelima

(57) ABSTRACT

A refuse receptacle accessory including a bag support assembly, a cover assembly and a receptacle assembly. A bag support is placed inside of a receptacle. The bag support includes flaps and slits that extend outwardly and away from the bag support along a perimeter thereof. The flaps and slits allow for enhanced airflow to occur within the receptacle to eliminate the vacuum that is created between the receptacle and the bag within. Further, a cover is mounted to a top side of the bag support. The cover is absorbent and scented to increase cleanliness and sanitation within the receptacle. The eliminated vacuum facilitates the removal of the bag from the receptacle in a manner that is efficient and easy to accomplish.

14 Claims, 6 Drawing Sheets

(56) References Cited

U.S. PATENT DOCUMENTS 5,036,999 A 8/1991 Bitsch
5,328,028 A * 7/1994 Hale ..... B65F 1/04 206/366
5,353,950 A * 10/1994 Taylor ..... B65F 1/062 206/390
5,390,812 A * 2/1995 Spiro ..... B65F 1/06 220/495.06
5,641,189 A * 6/1997 Landman ..... B66C 1/18 294/74
5,674,744 A * 10/1997 Reid ..... C05F 17/907 435/290.1
5,843,768 A * 12/1998 Lin ..... C05F 17/907 435/290.1
6,176,455 B1 * 1/2001 Ma ..... B65B 67/1233 141/391
6,305,567 B1 * 10/2001 Sulpizio ..... B65D 25/16 220/495.01
8,074,823 B1 * 12/2011 Steidinger, III ..... B65F 1/068 220/495.04
9,027,777 B1 5/2015 Steidinger
9,027,778 B1 * 5/2015 Slawinski, Jr. ..... B65F 1/1421 220/495.04
9,701,469 B1 * 7/2017 Reith ..... B65F 1/068
10,611,565 B2 * 4/2020 Housand ..... B65F 1/141
2007/0095839 A1 * 5/2007 Stone ..... B65F 1/068 220/495.06
2009/0194033 A1 * 8/2009 Modlin ..... A01K 1/0114 119/167
2010/0200592 A1 * 8/2010 Murdock ..... B65F 1/0006 220/495.06
2011/0217201 A1 * 9/2011 Jensen ..... B65F 7/00 422/5
2011/0308286 A1 * 12/2011 Cowie ..... B65F 1/04 71/14
2017/0096299 A1 * 4/2017 Yang ..... G10L 25/51
2017/0313505 A1 * 11/2017 Behrmann ..... B65F 1/0006

* cited by examiner

REFUSE RECEPTACLE ACCESSORY

BACKGROUND OF THE INVENTION

1. Field of the Invention

The present invention relates to a refuse receptacle accessory and, more particularly, to a refuse receptacle accessory that eliminates the vacuum created when a disposable bag is removed from a refuse receptacle to facilitate the removal of disposable bag from the refuse receptacle.

2. Description of the Related Art

Several designs for a refuse receptacle accessory have been designed in the past. None of them, however, include a refuse receptacle accessory system that includes a bag support with folds or slits and flaps, wherein the folds enhance airflow and prevent suction during removal and fitting of a bag within a refuse receptacle. The flaps further allow fitting and adherence of the bag support within a variety shaped sizes and shaped refuse receptacles.

Applicant believes that a related reference corresponds to U.S. Pat. No. 9,027,777 for a vented trash container with a manifold of air channels. Applicant believes another related reference relates to U.S. Pat. No. 5,036,999 for a waste-collecting container with a ventilating device. None of these references, however, teach of a refuse receptacle accessory system that includes a bag support with folds and flaps for eliminating a vacuum seal created when a bag is removed from a refuse receptacle. Further, the flaps permit the refuse receptacle accessory system to be retrofitted into existing refuse receptacles of different shapes and sizes.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a refuse receptacle accessory that helps to facilitate the removal of bags from refuse receptacle.

It is another object of the present invention to provide a refuse receptacle accessory that helps to reduce or eliminate a vacuum seal created within refuse receptacles.

It is still another object of the present invention to provide a refuse receptacle accessory that can be retrofitted into existing refuse receptacles of different shapes and sizes.

It is also another object of the present invention to provide a refuse receptacle accessory that helps to increase cleanliness and sanitation within a refuse receptacle.

It is still yet another object of the present invention to provide a refuse receptacle accessory that helps to reduce odors within refuse receptacles.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
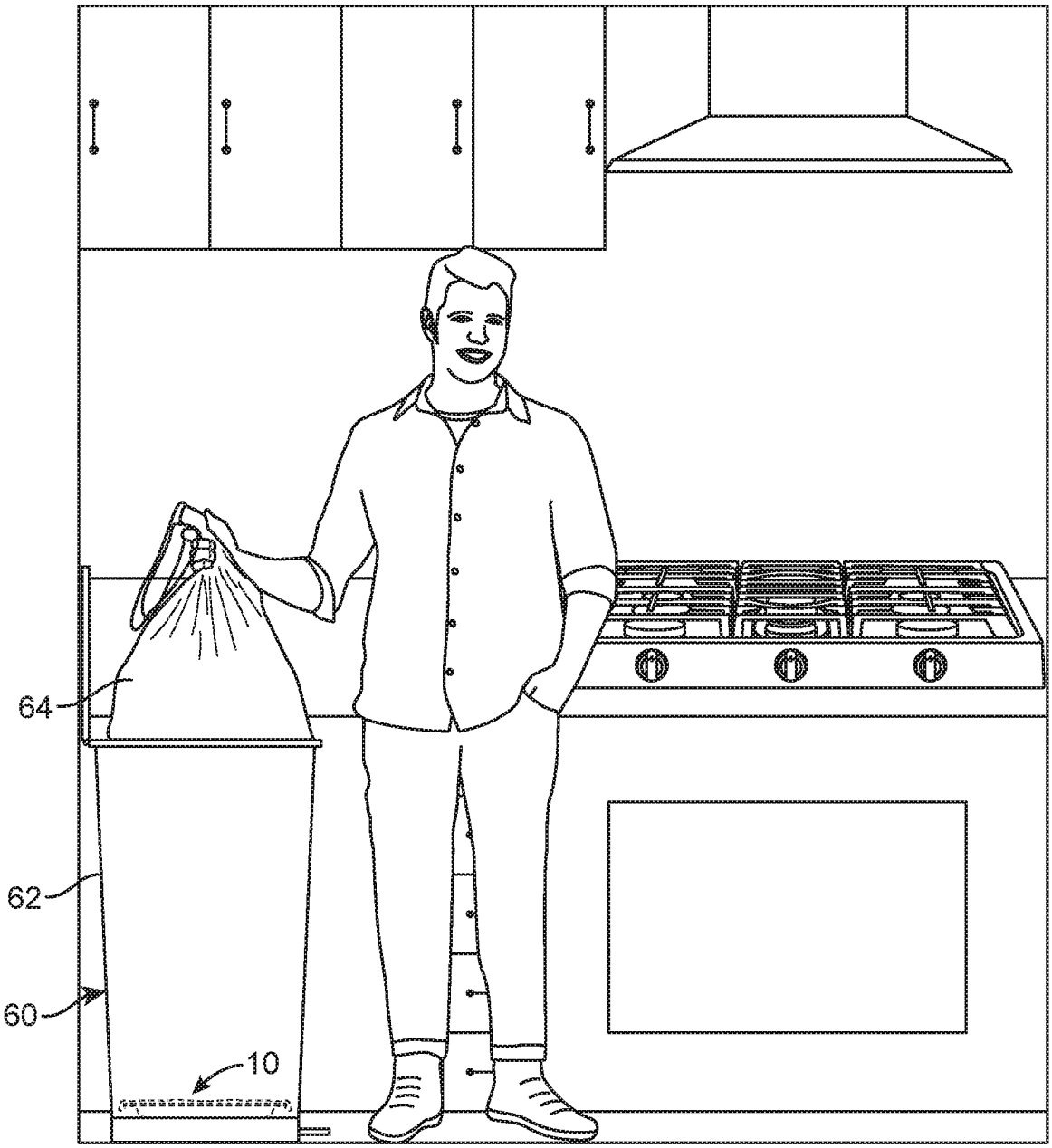
FIG. 1 represents the refuse receptacle accessory 10 in an operational setting inside of a receptacle 62 allowing a bag 64 to be removed with ease due to the vacuum seal being eliminated due to the refuse receptacle accessory 10.

Referring now to the drawings, where the present invention is generally referred to with numeral 10, it can be observed that it basically includes a bag support assembly 20, a cover assembly 40 and a receptacle assembly 60.

Figure 2:
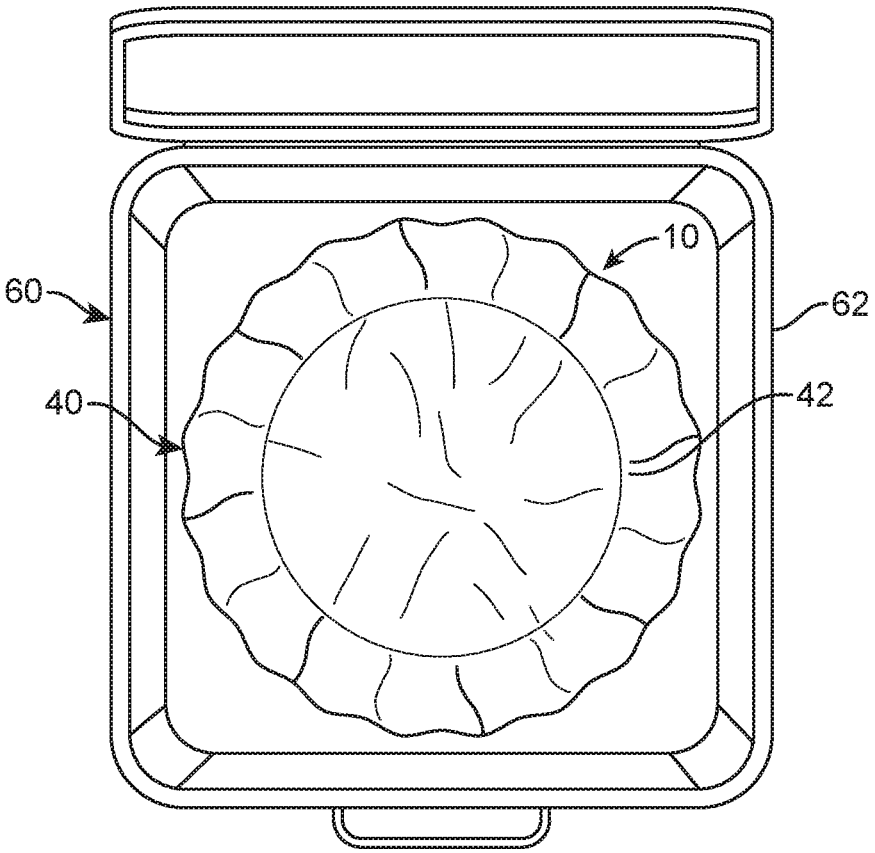
FIG. 2 shows a top view of receptacle 62 with refuse receptacle accessory 10 therein.

As best seen in FIG. 1-2, refuse receptacle accessory 10 may be used inside of a receptacle 62 to eliminate any vacuum seal created when a bag 64 is being removed from inside of receptacle 62. With the vacuum seal eliminated, removal of bag 64 from receptacle 62 may become very quick and easy. This helps the user reduce any struggles or frustrations that may otherwise arise.

It can be best seen in FIGS. 3-6 that bag support assembly 20 may include a bag support 22. Bag support 22 may be received within receptacle 62 as shown in FIG. 2. It is to be understood that bag support 22 may be retrofitted inside of different size and shaped receptacles. Bag support 22 may preferably be circular in shape, in one embodiment. Other predetermined shapes may be suitable for bag support 22 that cooperate with different of receptacle 62. Bag support 22 may preferably be flexible. Additionally, bag support 22 may be light weight. It may be suitable for bag support 22 to be made of materials such as rubber, aluminum, plastic, cloth, hemp, bamboo, wood pulp, microfiber, cellulose, polymer, polyethlene foam, stainless steel, cardboard, wood, metal, paper, or combinations thereof. Preferably, the present invention may be disposable. However, it is to be understood that bag support 22 may be reusable period of time before becoming dirty from liquids or other items that may seep out through bag 64.

Figure 3:
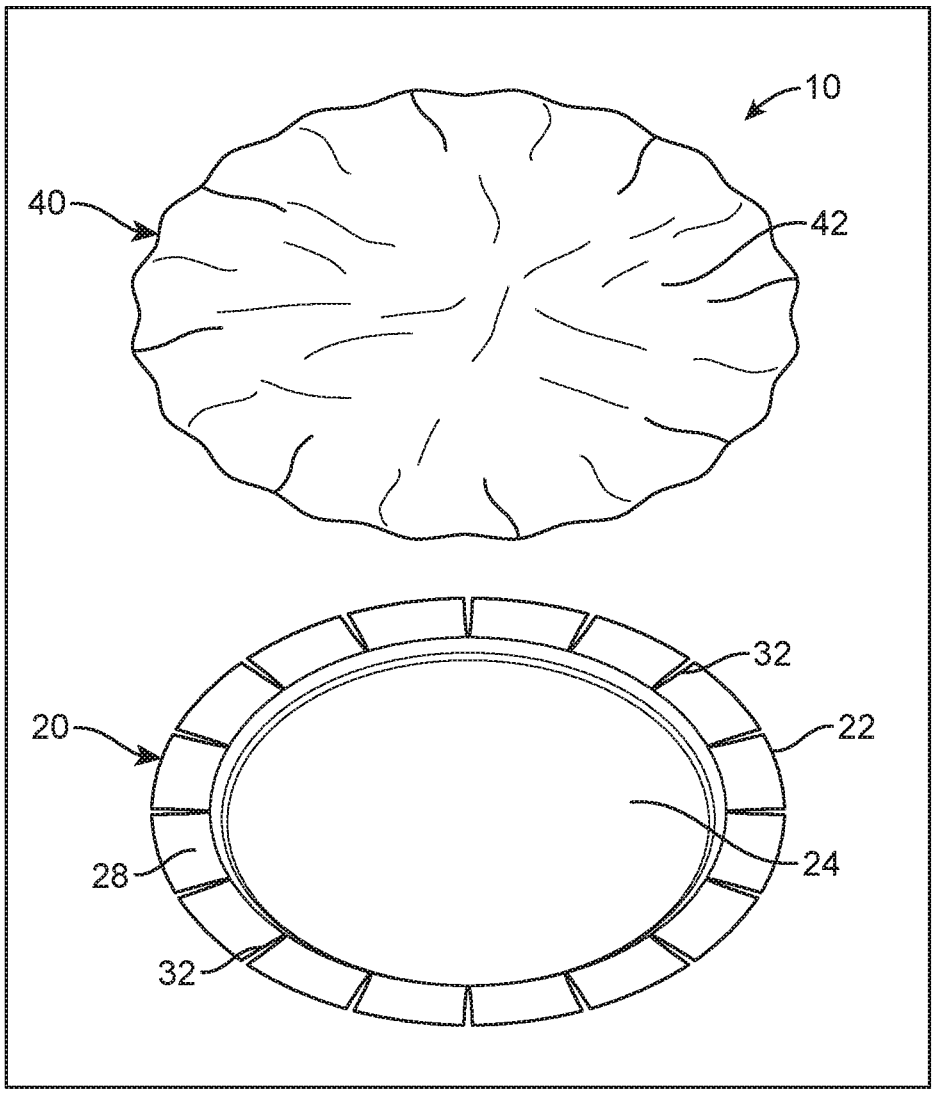
FIG. 3 illustrates an exploded view of refuse receptacle accessory 10.
Figure 5:
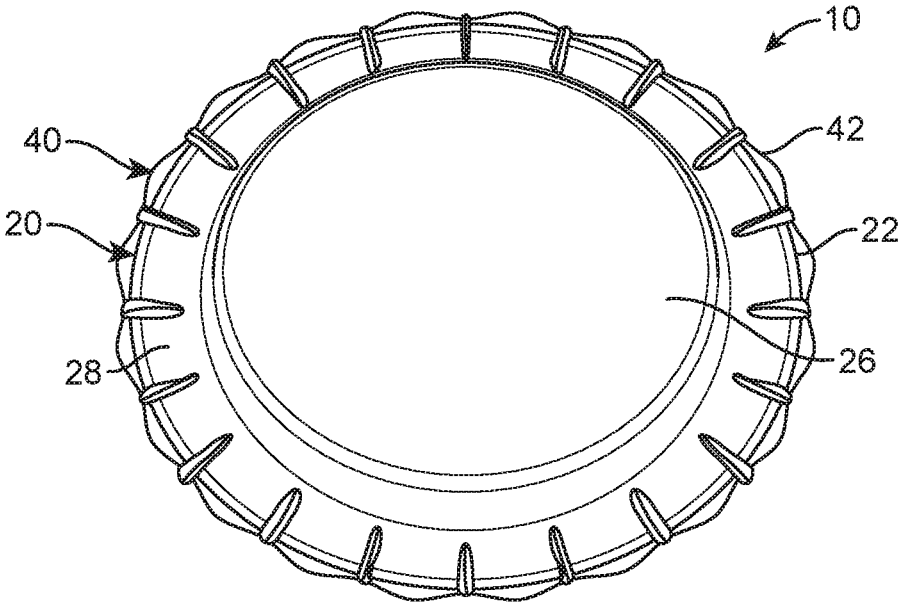
FIG. 5 is a representation of a bottom view of the refuse receptacle accessory 10.
Figure 6:
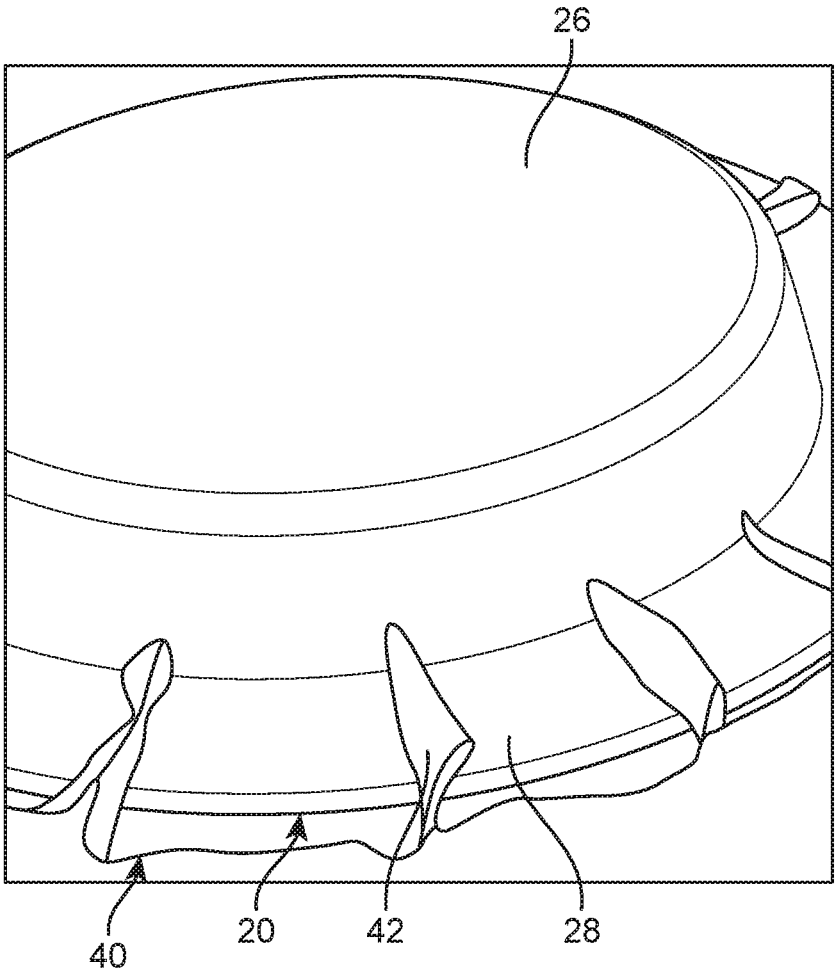
FIG. 6 illustrates a zoomed in view showing how cover 42 is attached to bag support 22.
Figure 7:
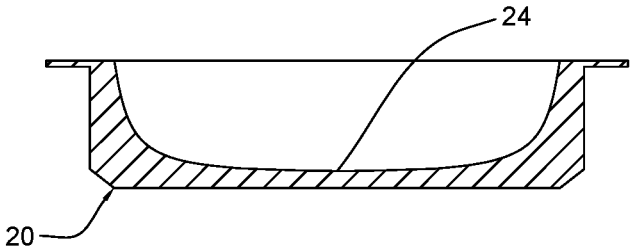
FIG. 7 represents an enlarged cross-sectional view of the bag support assembly 20.

It is to be understood that bag support 22 may include a top side 24 and a bottom side 26 as seen in FIGS. 3 and 5, respectively. Top side 24 of bag support 22 may preferably be concave, in one embodiment. Preferably, bottom side 26 may be flat. Bottom side 26 may be in constant contact with the interior floor of receptacle 62. In one embodiment, bag 64 may be directly atop of top side 24 within receptacle 62. However, depending on the dimensions of bag 64, it may also be suitable for bag 64 to hover above of top side 24 within receptacle 62. Any of the contents from within bag 64 that may accidently be release may be caught on top side 24 of bag support 22.

As best seen in FIGS. 3-6, it can be seen that bag support assembly 20 may further include flaps 28. Flaps 28 may extend about the perimeter of bag support 22. Flaps 28 may be evenly spaced apart. Flaps 28 may be of predetermined dimensions that cooperate with different receptacles. Flaps 28 may preferably be flexible and foldable. Flaps 28 may be substantially rectangular in the preferred embodiment. It is to be understood that preferably each of flaps 28 may include a flap length and a flap width, with the flap length being greater than the flap width. Flaps 28 may have a lowered and raised configuration. The lowered and raised configuration may be used to cooperate with different receptables. In the lowered configuration, flaps 28 may extend laterally outwardly and away from bag support 22. In the raised configuration, flaps 28 may extend vertically and away from top side 24 of bag support 22. The raised configuration may be the preferred configuration. Flaps 28 may become raised when bag support 22 is secured within a smaller receptacle 62 with a receptacle having a width less than that of the present invention. Flaps 28 in the raised configuration are in constant contact with the interior sidewalls of receptacle 62.

As best seen in FIG. 3, it can be seen that between each of flaps 28 may be slits 32. Slits 32 may alternative be referred to as folds. Slits 32 permit flaps 28 to be moved upwardly or downwardly. Slits 32 define the spacing between each of flaps 28. Slits 32 may extend about the length of flaps 28. Importantly, slits 32 eliminate the vacuum or suction created between the interior of receptacle 62 and the sides of bag 64 when bag is removed from therein. Slits 32 allow air to circulate between receptacle 62 and bag 64 to eliminate the negative air pressure created within receptacle 62. The enhanced airflow facilitates the efficient removal of bag 64. This may be helpful to users who are weak due to deteriorating health or other debilitating conditions and circumstances. Additionally, slits 32 may be used to allow cover assembly 40 to be securely mounted to bag support 22.

Figure 4:
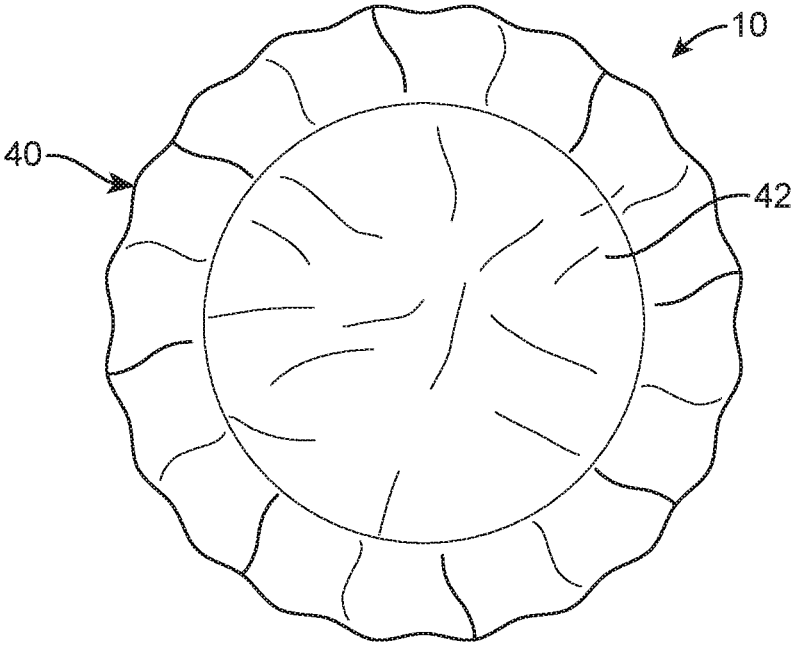
FIG. 4 represents a top view of the refuse receptacle accessory 10.

Cover assembly 40, as best seen in FIGS. 2-4, may include a cover 42. Cover 42 may preferably be mounted onto top side 24 of bag support 22. Cover 42 may entirely cover top side 24. In one embodiment, cover 42 may be wider than bag support 22. Cover 42 may extend over the edge of cover 42, preferably as best seen in FIG. 5. Cover 42 may need to be secured to bag support 22. Cover 42 may be partially secured between slits 32. Flaps 28 may be lifted allowing slits 32 to pinch portions of cover 42 therebetween. The portions of cover 42 between slits 32 may be perpendicular to slits 32. Slits 32 release cover 42 by lifting flaps 28. Cover 42 may preferably be made of an absorbent cloth material. It may be suitable for cover 42 to be made of cotton, wool, polyester, paper, hemp, bamboo, wood pulp, microfiber, cellulose, polymer, polyethylene foam, other suitable materials or combinations thereof. Cover 42 may help to keep the interior of receptacle 62 clean by catching and absorbing the contents that may accidently release from bag 64. This may reduce the need for the user to spend excess time cleaning receptacle frequently. Cover 42 may be most beneficial for gathering and preventing liquids from making a mess within receptacle 62. Furthermore, cover 42 may be scented. The scent from cover 42 may help to reduce undesirable odors within receptacle 62. It is to be understood that cover 42 may be scented with predetermined aromas. The scented cover 42 may help to enhance the surroundings of the user.

The present invention may be inserted inside of receptacle 62 to increase cleanliness and sanitation. Importantly, refuse receptacle accessory 10 may help to enhance airflow within receptacle 62 to facilitate the removal of bag 64 from receptacle 62 without troubles or struggles. The present invention assist the user to having an easier and more pleasant time when dealing with trash bags. It may be suitable to use the present invention with receptacles that are indoors or outdoors.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a refuse receptacle accessory, comprising:

a. a bag support assembly including a bag support, said bag support including a bottom side, a top side, a sidewall, flaps and slits, said sidewall connecting said top side with said bottom side, said sidewall elevating said top side from the bottom side defining a concave top side, said flaps extending about a perimeter of said bag support, said slits being between each of said flaps;

b. a cover assembly including a cover, said cover mounted to said bag support;

c. a receptacle assembly including a receptacle and a bag, said bag support received within said receptacle and below said bag, said bag support and slits enhancing airflow within said receptacle to eliminate the vacuum created between said bag and said receptacle when said bag is being removed from said receptacle said concave top side enhancing airflow within a floor of said receptacle and said bag support.

2. The system of claim 1 wherein said cover is mounted to said top side.

3. The system of claim 1 wherein said bottom side is in constant support with the floor of said receptacle.

4. The system of claim 1, wherein said cover extends over peripheral edges of said bag support.

5. The system of claim 1, wherein said flaps are flexible.

6. The system of claim 1, wherein said cover is secured between said slits.

7. The system of claim 6, wherein said cover is secured perpendicularly to said slits.

8. The system of claim 1, wherein said cover is scented.

9. The system of claim 1, wherein said cover is absorbent to catch spills from said bag.

10. The system of claim 1, wherein said bag support and said cover are disposable.

11. The system of claim 1, wherein said flaps extend outwardly and away from said top side.

12. The system of claim 1, wherein said slits extend along a length of said flaps.

13. A system for a refuse receptacle accessory, comprising:

a. a bag support assembly including a bag support, said bag support including flaps and slits, said flaps extending about a perimeter of said bag support, said flaps extending outwardly and away from a top side of said bag support, said slits being between each of said flaps, said bag support further including a bottom side, said top side being concave, said bottom side being flat, said flaps being flexible, said bag support has a circular shape;

b. a cover assembly including a cover, said cover mounted to said bag support on said top side, said cover perpendicularly secured between said slits, said cover being scented and absorbent, said cover catching spills from said bag, said cover extending over edges of said bag support, said cover has a circular shape;

c. a receptacle assembly including a receptacle and a bag, said bag support received within said receptacle and entirely below said bag, said bottom side being in constant contact with a floor of said receptacle, said bag support and slits enhancing airflow within said receptacle to eliminate the vacuum created between said bag and said receptacle when said bag is being removed from said receptacle.

14. A system for a refuse receptacle accessory, consisting of:

a. a bag support assembly including a bag support, said bag support including a top side, a bottom side, a sidewall, flaps and slits, said sidewall connecting said top side with said bottom side, said sidewall elevating said top side from the bottom side defining a concave top side wall, said flaps extending about a perimeter of said bag support, said flaps extending outwardly and away from said top side, said slits being between each of said flaps, said top side being concave, said bottom side being flat, said flaps being flexible—said bag support has a circular shape;

b. a cover assembly including a cover, said cover mounted to said bag support on said top side, said cover perpendicularly secured between said slits, said cover being scented and absorbent, said cover catching spills from said bag, said cover extending over edges of said bag support, said cover has a circular shape;

c. a receptacle assembly including a receptacle and a bag, said bag support received within said receptacle and entirely below said bag, said bottom side being in constant contact with a floor of said receptacle, said bag support and slits enhancing airflow within said receptacle to eliminate the vacuum created between said bag and said receptacle when said bag is being removed from said receptacle, said concave top side enhancing airflow within a floor of said receptacle and said bag support.

* * * * *